US012317953B2

(12) United States Patent
Takamasu et al.

(10) Patent No.: US 12,317,953 B2
(45) Date of Patent: Jun. 3, 2025

(54) SHOE

(71) Applicant: ASICS Corporation, Hyogo (JP)

(72) Inventors: Sho Takamasu, Hyogo (JP); Kei Kanematsu, Hyogo (JP); Shigeyuki Mitsui, Hyogo (JP); Keita Ozawa, Hyogo (JP); Genki Hatano, Hyogo (JP); Seigo Nakaya, Hyogo (JP)

(73) Assignee: ASICS Corporation, Hyogo (JP)

( * ) Notice: Subject to any disclaimer, the term of this patent is extended or adjusted under 35 U.S.C. 154(b) by 253 days.

(21) Appl. No.: 17/624,703

(22) PCT Filed: Jul. 12, 2019

(86) PCT No.: PCT/JP2019/027765
§ 371 (c)(1),
(2) Date: Jan. 4, 2022

(87) PCT Pub. No.: WO2021/009810
PCT Pub. Date: Jan. 21, 2021

(65) Prior Publication Data

US 2022/0248805 A1 Aug. 11, 2022

(51) Int. Cl.
*A43B 13/28* (2006.01)

(52) U.S. Cl.
CPC ..... *A43B 13/28* (2013.01)

(58) Field of Classification Search
CPC . A43B 23/026; A43B 23/027; A43B 23/0235; A43B 13/28; A43B 23/0245; A43B 23/07; A43B 13/023
See application file for complete search history.

(56) References Cited

U.S. PATENT DOCUMENTS 5,704,138 A 1/1998 Donnadieu
6,367,168 B1 4/2002 Hatfield et al.
6,658,766 B2 * 12/2003 Kraeuter ..... A43B 5/00 36/102

(Continued)

FOREIGN PATENT DOCUMENTS

JP 3902612 B2 4/2007
WO 02/07553 A1 1/2002

OTHER PUBLICATIONS

International Preliminary Report on Patentability issued on International Patent Application No. PCT/JP2019/027765, dated Dec. 22, 2020, with English translation.

(Continued)

*Primary Examiner* — Alissa L Hoey
*Assistant Examiner* — Akwokwo Olabisi Redhead
(74) *Attorney, Agent, or Firm* — Rimon P.C.

(57) ABSTRACT

A shoe includes a midsole and an upper joined to the midsole. A joint position between the midsole and a base end part of the upper is located inside in a width direction with respect to an outer circumferential edge of a top surface of the midsole. The shoe in another aspect includes the midsole, a first upper joined to the midsole, and a second upper disposed on the outside in a width direction of the first upper. A first joint position between the midsole and the base end part of the first upper is located on the inside in a width direction of a second joint position between the midsole and a base end part of the second upper, and an upper edge of the second upper is joined to the first upper.

5 Claims, 5 Drawing Sheets

(56) References Cited

U.S. PATENT DOCUMENTS

| | | | | |
|---|---|---|---|---|
| 10,178,891 | B2 * | 1/2019 | Christensen | A43B 7/1445 |
| 2012/0198720 | A1 | 8/2012 | Farris et al. | |
| 2013/0104422 | A1 | 5/2013 | Hatfield et al. | |
| 2014/0202034 | A1 | 7/2014 | VanAtta | |
| 2018/0132559 | A1 * | 5/2018 | Jacobsen | H01Q 1/273 |

OTHER PUBLICATIONS

Extended European Search Report issued in corresponding European Patent Application No. 19937367.1, dated May 11, 2022.
Chinese Office Action issued in corresponding Chinese Application No. 201980098058.5, dated May 26, 2023, with English translation.
Chinese Office Action dated Dec. 4, 2023 issued in the corresponding Chinese Patent Application No. 201980098058.5, with English translation.

* cited by examiner

SHOE

CROSS REFERENCE

This application is the U.S. National Phase under 35 U.S.C. § 371 of International Application No. PCT/JP2019/027765, filed on Jul. 12, 2019, the entire contents are hereby incorporated by reference.

TECHNICAL FIELD

The present invention relates to a shoe, and particularly to a shoe with improved fit.

BACKGROUND ART

Conventionally, shoes have been devised to appropriately fit onto various sizes of feet. As foot sizes, dimensions including a foot width, a foot length, and an instep height are generally known. To make a shoe that satisfies all these dimensions, such a shoe has substantially needed to be fully made to order.

Especially, with regard to shoes manufactured in commercial production lines, the types of manufacturable shoes are limited. Accordingly, at present, shoe sizes (such as the foot width, foot length, and instep height) that statistically fit onto many people are considered, and a shoe having a specific length is set to have a certain foot width and a certain instep height to be manufactured.

In recent years, there have been developed a shoe that has a specific size but the fit thereof is adjustable to some extent (Patent Literature 1, for example).

PRIOR ART REFERENCE

Patent Literature

Patent Literature 1: Japanese Patent No. 3902612

SUMMARY OF INVENTION

Technical Problem

A purpose of the present invention is to improve the fit of a shoe by means other than those described in Patent Literature 1.

In response to the above issue, in the present invention, a sole and an upper joined to the sole are provided, and a joint position between the sole and a base end part of the upper is located inside in a width direction with respect to an outer circumferential edge of a top surface of the sole.

Advantageous Effects of Invention

As described above, the present invention improves the fit of a shoe.

DESCRIPTION OF EMBODIMENTS

Definitions of terms used in this specification will be described first. In this specification, front and rear directions (longitudinal directions), width directions, and vertical directions may be used as terms indicating directions. These terms indicate directions viewed from a viewpoint of a wearer wearing a shoe placed on a flat surface. Accordingly, the front direction means a direction toward the toe side, and the rear direction means a direction toward the heel side. Also, a medial side and a lateral side of a foot may also be used as terms indicating directions. The medial side of a foot means the inner side of the foot in a width direction, i.e., a longitudinal arch side of the foot, and the lateral side of the foot means the side opposite to the medial side along a width direction.

Also, in the following description, a sole of a shoe may be referred to. The sole means an outsole of a shoe including a ground contact surface, a midsole disposed on the outsole, or the both. Also, in the following description, the outside (direction) or the inside (direction) of the midsole may be referred to. The outside of the midsole means, when viewed from the top, every direction away from a surface of the midsole. The inside of the midsole means, when viewed from the top, every direction from the outside of the midsole toward the inside of a surface of the midsole. Further, in some examples, directions may be described using a three-dimensional Cartesian coordinate system. In this case, the X-axis extends from the medial side toward the lateral side of the foot, the Y-axis extends from the heel side toward the toe side, and the Z-axis extends from the bottom surface side toward the upper side.

Before a shoe according to an embodiment is described, a foot skeleton relevant to the shoe according to the embodiment will be described with reference to FIG. 1.

Figure 1:
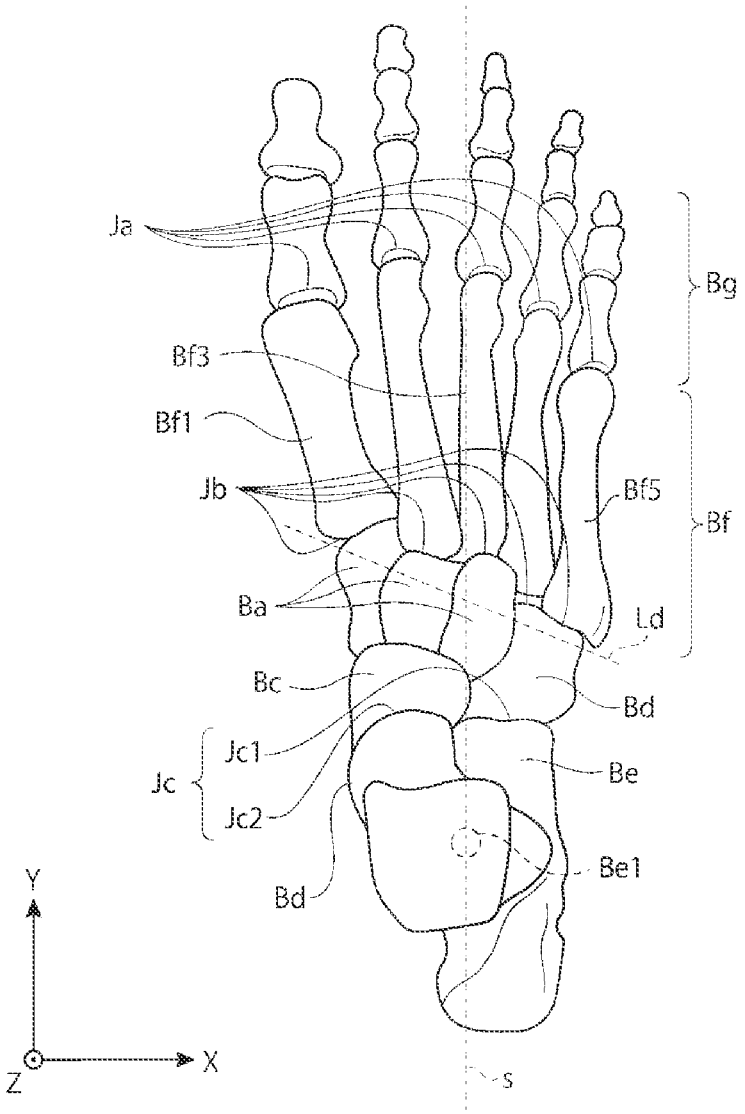
FIG. 1 is a top view of a foot skeleton.

FIG. 1 is a top view of a foot skeleton. A human foot is mainly constituted by cuneiform bones Ba, a cuboid bone Bb, a navicular bone Bc, a talus Bd, a calcaneus Be, metatarsal bones Bf, and phalanges Bg. Joints of a foot include MP joints Ja, Lisfranc joints Jb, and a Chopart's joint Jc. The Chopart's joint Jc includes a calcaneocuboid joint Jct formed by the cuboid bone Bb and the calcaneus Be, and a talocalcaneonavicular joint Jc2 formed by the navicular bone Bc and the talus Bd. In this specification, a "forefoot portion" of a wearer means a portion positioned forward of the MP joints Ja; when it is restated with shoe length ratio, the forefoot portion means a portion between the positions of 0% and about 30% of the entire shoe length measured from the toe side. Also, a "midfoot portion" means a portion from the MP joints Ja to the Chopart's joint Jc and corresponds, similarly, to a portion between the positions of about 30% and 80% of the entire shoe length measured from the toe side. Also, a "rearfoot portion" means a portion positioned rearward of the Chopart's joint Jc and corresponds, similarly, to a portion between the positions of about 80% and 100% of the entire shoe length measured from the toe side. In FIG. 1, a center line S indicates a center line of a shoe and extends along a middle part in a foot width direction. The center line S is assumed to be a region positioned on a straight line passing through a third metatarsal bone Bf3 and a medial process Be1 of calcaneal tuberosity of the calcaneus Be in a human body. FIG. 1 shows an area in which the medial process Be1 of calcaneal tuberosity is assumed to be positioned.

Figure 2:
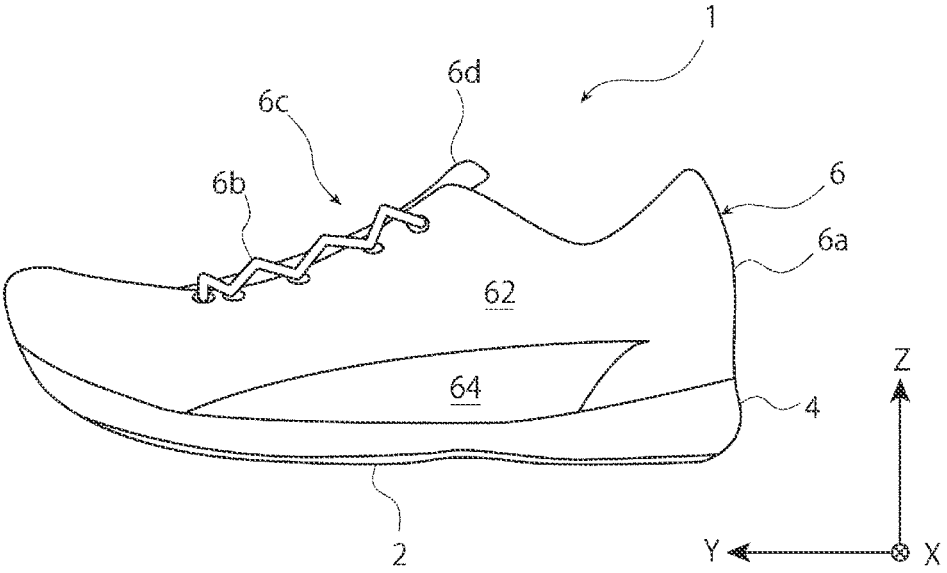
FIG. 2 is a side view of a shoe according to an embodiment of the present invention.
Figure 3:
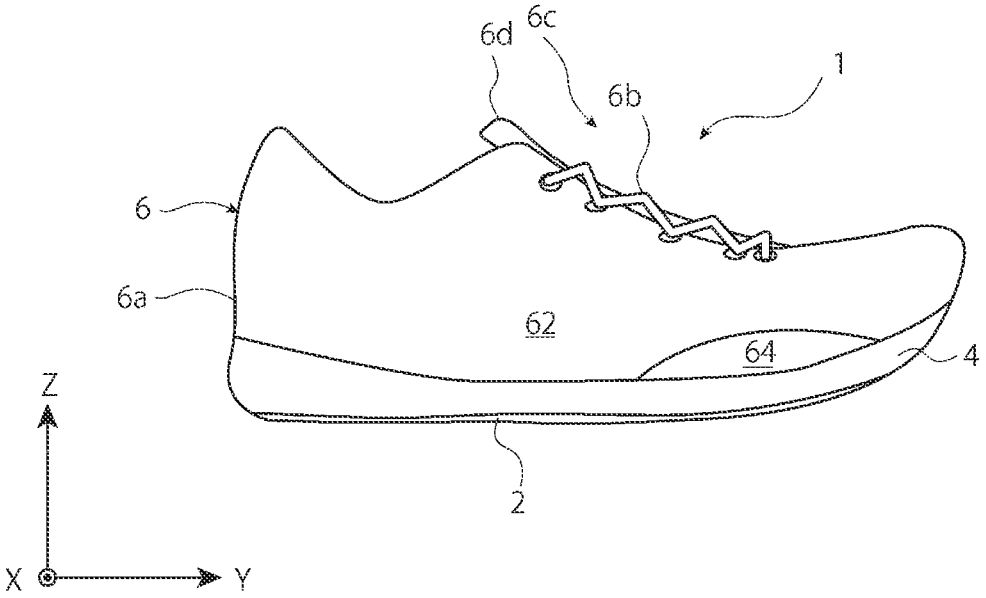
FIG. 3 is another side view of the shoe.

FIGS. 2 and 3 are side views of a shoe. FIG. 2 is a side view of the shoe viewed from the medial side of the foot, and FIG. 3 is a side view of the shoe viewed from the lateral side of the foot. As illustrated in FIGS. 2 and 3, a shoe 1 includes an outsole 2 having a ground contact surface, a midsole 4 disposed on the outsole 2, and an upper 6 that covers an instep.

The upper 6 has a shape that covers a top side of an instep. The upper 6 includes an upper body 6*a*, a tightening means (tightening structure) 6*b* for the upper 6, and a slit 6*c* that extends along a longitudinal direction of the upper 6 around the middle in a width direction of the upper 6. Also, to the upper 6, a shoe tongue 6*d* is attached. In the present embodiment, as the tightening means 6*b*, a structure constituted by a combination of eyelets and a shoelace is employed. As the tightening means, a hook-and-loop fastener or the like may also be used. Also, the upper 6 may have a monosock structure in which the slit 6*c* and the shoe tongue 6*d* are not provided.

The upper body 6*a* may be made of a mesh material obtained by knitting synthetic fiber, such as polyester and polyurethane, or made of synthetic leather or natural leather, for example, and has a shape covering an instep. The slit 6*c* is a buffer portion provided to adjust the width of the upper body 6*a* by adjusting the degree of tightening of the shoelace. On each side in a width direction of the slit 6*c*, multiple eyelets (tightening parts) are provided. The shoe tongue 6*d* is exposed through the slit 6*c*, and, when the shoelace is tied, the shoelace has no contact with the wearer's instep.

The outsole 2 may be formed of rubber, rubber foam, thermoplastic polyurethane (TPU), a thermoplastic elastomer, or a thermosetting elastomer, for example. The outsole 2 is formed such that multiple insular portions thereof are pasted onto predetermined positions on the bottom surface of the predetermined midsole 4. The ground contact surface is formed by the bottom surfaces of the multiple insular portions, and the bottom surface of the midsole 4 is exposed between the insular portions. The shapes of the outsole 2 and the ground contact surface are not particularly limited, and the outsole 2 may be formed by one flat sheet member. In this case, the bottom surface of the sheet member forms the ground contact surface.

The midsole 4 has a function to absorb impact and is formed of a material for absorbing impact, such as expanded EVA, urethane foam, GEL, and cork. The midsole 4 has a planar shape approximated to a projected shape of a foot in top view. The top surface of the midsole 4 has an uneven shape that corresponds to an uneven shape of the sole of a foot. To the top surface of the midsole 4, the upper 6 is joined. More specifically, the upper 6 is joined along the shape of the midsole 4. To join the upper 6 to the midsole 4, a base end part of the upper 6 may be sewn onto the midsole 4, or a bonding means, such as an adhesive, may be used for the joining, for example. The shape and thickness of the midsole 4 may be appropriately set depending on the use of the shoe 1.

Figure 4:
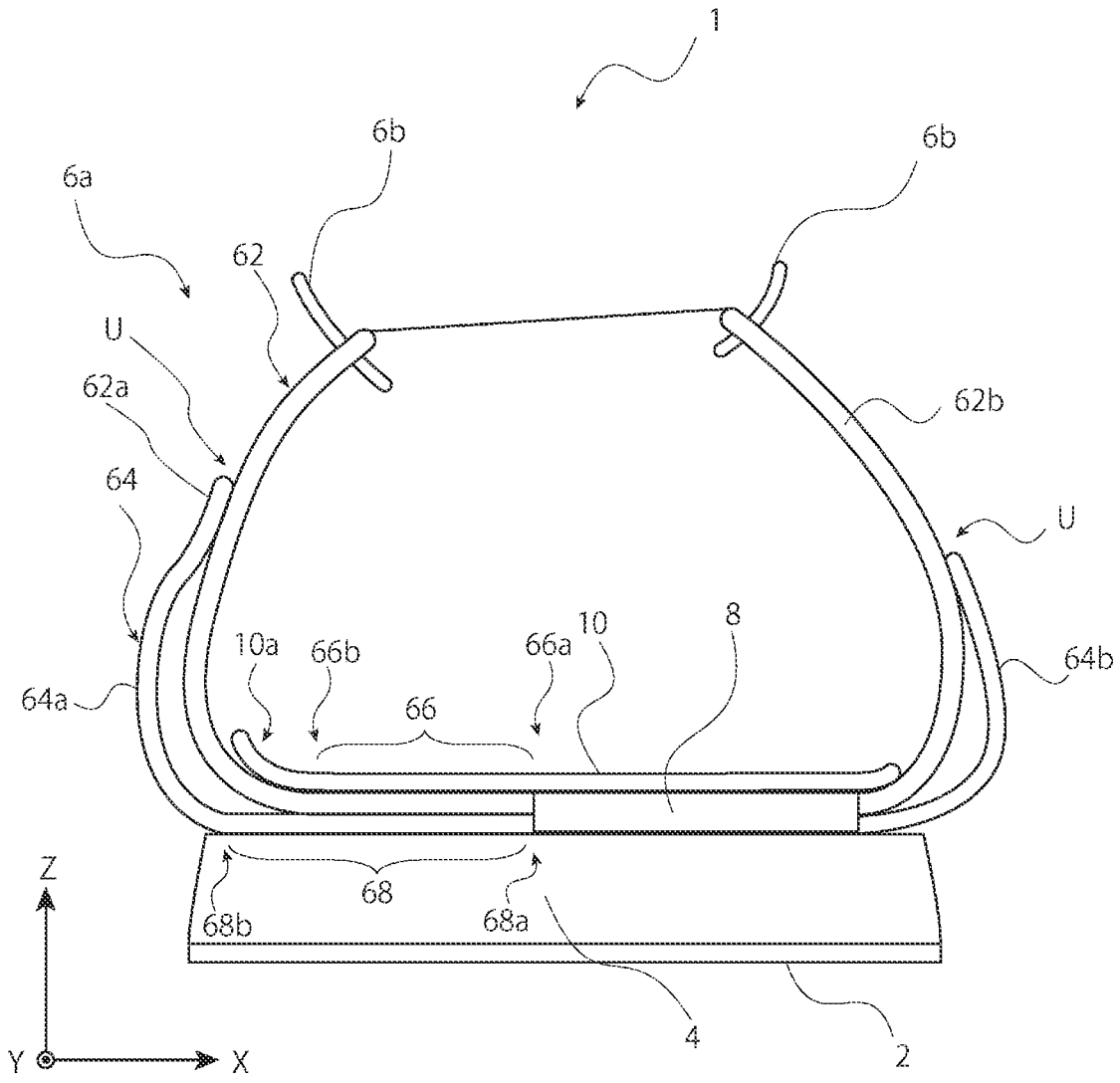
FIG. 4 is a sectional view along the X-Z plane of the shoe.

FIG. 4 is a sectional view along the X-Z plane of the shoe. The upper body 6*a* may suitably have a double-layered structure. More specifically, the upper body 6*a* includes a first upper 62 and a second upper 64. The first upper 62 covers an instep overall, and the second upper 64 partially covers a portion corresponding to a side surface of an instep on the outside of the first upper 62.

Figure 5:
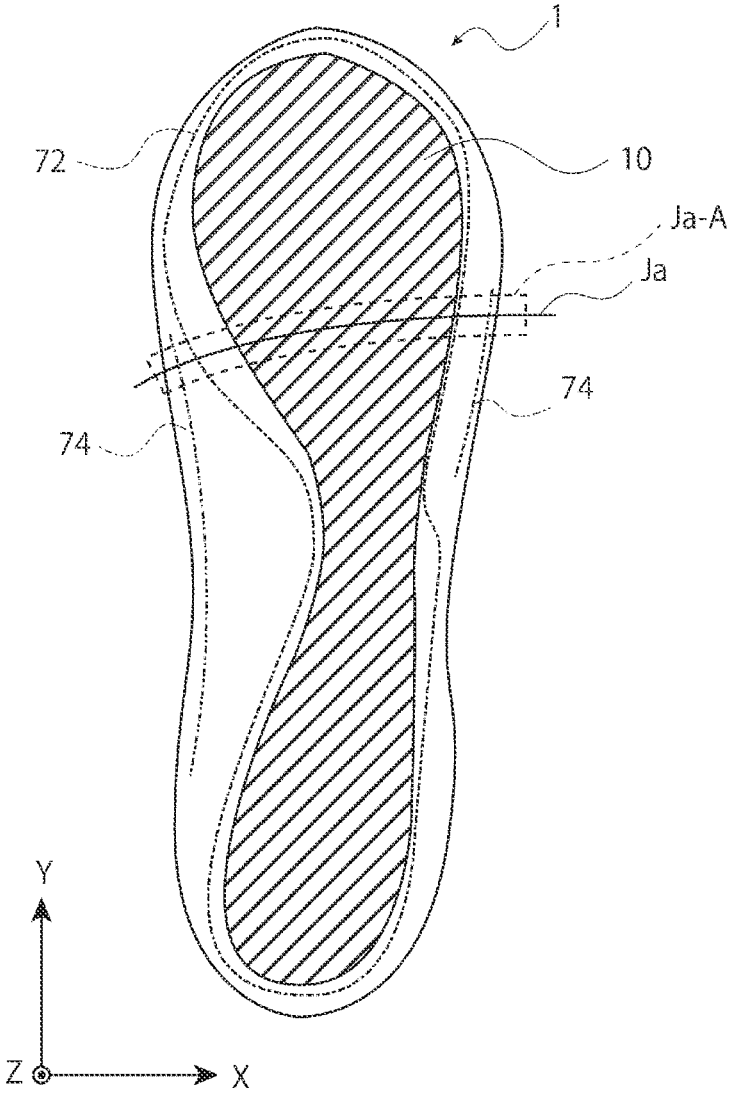
FIG. 5 is a top view of the shoe in which part of the upper is omitted.

As illustrated in FIG. 4, inside the shoe 1, an insole 8 is placed over the midsole 4, and a sock liner 10 is placed over the insole 8. The insole 8 is bonded onto the midsole 4 or attached onto the midsole 4 by means of a hook-and-loop fastener. The first upper 62 covers around an instep. The first upper 62 includes a first medial upper 62*a* that covers an instep from the medial side, and a first lateral upper 62*b* that covers the instep from the lateral side. At an end in a Z direction of each of the first medial upper 62*a* and the first lateral upper 62*b*, eyelets as the tightening means 6*b* are provided, through which a shoelace is inserted. The vicinity of the other end of each of the first medial upper 62*a* and the first lateral upper 62*b* extends along the top surface of the midsole 4 from an outer circumferential edge of the midsole 4 toward the center of the midsole 4. A portion around the other end of a first upper 62 extending along the X-Y plane from the outer circumferential edge toward the center of the midsole 4 will be referred to as a base end part 66 of the first upper. An inner end 66*a* of the base end part 66 extends to the insole 8 to be sewn onto an end surface of the insole 8. When the insole 8 is not provided, the base end part 66 is directly bonded onto the top surface of the midsole 4. The length of the base end part 66 may suitably be 5 mm or longer, for example. The inner end 66*a* of the base end part 66 is joined to the midsole 4 (sole) via the insole 8 along a joint line extending in a longitudinal direction of the shoe 1 to form a straight line or a curved line. Meanwhile, an outer end 66*b* of the base end part 66 is not fixed to the sole. In other words, a joint position (a first joint position 72) between the midsole 4 (sole) and the base end part 66 of the first upper 62 (upper) is positioned inside in a width direction by a predetermined distance with respect to the outer circumferential edge of the top surface of the midsole 4. As described previously, the object to which the base end part 66 is joined is not limited to the insole 8 and may be the midsole 4 (sole). Further, in the midfoot portion, for example, the joint position (first joint position 72) on the medial side may be located closer to the middle in a width direction than the joint position (first joint position 72) on the lateral side, as illustrated in FIG. 5. More suitably, the joint position may be provided in the middle in a width direction such as to be greatly curved near the middle in the entire length of the shoe 1. In this case, the amount of deformation of the first upper 62 on the medial side can be increased so that the first upper 62 especially fits onto a longitudinal arch part as appropriate.

As a method for joining a first upper 62 to the sole, there are various methods, such as joining by sewing and joining with a hook-and-loop fastener. When sewing is employed, the sewn line extends in a longitudinal direction of the shoe 1. When a hook-and-loop fastener is employed, multiple hook-and-loop fasteners having a width narrower than the insole 8 may be prepared and arranged along the middle in a width direction of the midsole 4. The sewn line may suitably be positioned closer to the outside of the midsole than offset positions where the center line S of the shoe is shifted, by about 5 mm, to the medial side and the lateral side. Thus, a first upper 62 is disposed on the inside in a width direction of the outer circumferential edge of the sole and only the inner end of the first upper 62 is joined to the sole, so that the first upper 62 can move freely with respect to the sole. In this case, the base end part 66 of the first upper 62 can particularly move freely with respect to the sole. Since the first upper 62 is made to move freely with respect to the sole, the shoe 1 can fit various sizes. If the width of a foot is larger than the width of the midsole 4, the first upper 62 will be broadened in a width direction when the foot is inserted into the upper 6. In this state, by pulling and tying the shoelace, the first upper 62 can be made to fit onto the foot. If the width of a foot is smaller than the width of the midsole 4, on the other hand, the first upper 62 will not come into contact with the foot when the foot is inserted into the upper 6. This significantly occurs particularly in the longitudinal arch part. In this state, by pulling the shoelace, the first upper 62 will be lifted from the top surface of the midsole 4, so that the base end part 66 of the first upper 62, which can move freely with respect to the sole, comes into contact with the sole of the foot. By tying the shoelace in this state, the state of the base end part 66 of the first upper 62 in contact with the sole of the foot can be maintained.

As described previously, the joint position of a first upper 62 may be adjusted such that the first upper 62 can move freely with respect to the sole. However, the first upper 62 need not necessarily be made to move freely with respect to the sole in the entire region of the top surface of the midsole 4. The area in which the first upper 62 can move freely with respect to the sole may be limited. In this case, the first upper 62 may be made to move freely with respect to the sole only on the medial side of the midfoot portion that is likely to give a tightening feeling when the size of the shoe 1 does not fit; in other portions, the base end part 66 of the first upper 62 may be joined to the outer circumferential edge of the sole.

The second upper 64 is joined to both a first upper 62 and the sole, which improves unity of the first upper 62 and the sole. When the second upper 64 is provided at a position where the first upper 62 can move freely with respect to the sole, entering of foreign matter, such as a small stone, between the first upper 62 and the sole can be prevented. The second upper 64 may suitably be formed of a material having higher stretchability than the first upper 62. In the illustrated example, the shoe 1 includes a second medial upper 64*a* provided on the medial side and a second lateral upper 64*b* provided on the lateral side. These second uppers 64 are separated from each other and are not connected. The second medial upper 64*a* may suitably be formed around the midfoot portion, for example. Similarly, the second lateral upper 64*b* may also suitably be formed around the midfoot portion, for example. The second uppers 64*a* and 64*b* are not essential configurations, and one or both of them may be omitted.

When the shoe 1 is viewed from a side, an upper edge of a second upper 64 extends from the midsole 4 to around the middle in a Z direction of the upper 6, and the second upper 64 is joined to a first upper 62 only at an upper edge U. Being joined only at an upper edge U means that a portion between a base end part 68 of the second upper 64 and the upper edge U is not joined and can move freely with respect to the first upper 62. The joint position between the upper edge U of the second upper 64 and the first upper 62 may suitably be located at a position that can be at least partially recognized visually when the shoe 1 is viewed from the top. Being recognized visually as used herein does not mean that the joint position between the upper edge U of the second upper 64 and the first upper 62 should necessarily be recognized visually from the outside. Accordingly, even if a member for covering the joint position is provided, it will be acceptable when, after the member is removed and the joint position is exposed, the second upper 64 is found to extend in a z direction to a position visually recognized from the above. In other words, it means that the upper edge U of the second upper 64 is positioned on the z direction side with respect to a portion projecting outermost in the shoe when a wearer wears the shoe. By positioning the upper edge U of the second upper 64 in this way, the foot can be appropriately covered with the second upper 64. The joint position between the upper edge U of the second upper 64 and the first upper 62 may suitably be located on the sole side with respect to the eyelets (tightening parts) provided on the first upper 62. In this case, stretchability of the second upper can be maintained without influence of the tightening state. The upper edge U of the second upper 64 may be joined to the first upper 62 in the entire region in a Y-axis direction or may be partially joined to the first upper 62.

A lower end of a second upper 64 is joined to the top surface of the sole. In this example, a second upper 64 is joined to the top surface of the midsole 4. As described above, the upper edge U of the second upper 64 is joined to a first upper 62, and the vicinity of the other end of the second upper 64 extends along the top surface of the midsole 4 from an outer circumferential edge toward the center of the midsole 4. A portion around the other end of the second upper 64 extending along the X-Y plane from the outer circumferential edge toward the center of the midsole 4 will be referred to as the base end part 68 of the second upper 64. An inner end 68*a* of the base end part 68 of the second upper 64 extends to the insole 8 to be sewn onto the insole 8. Meanwhile, an outer end 68*b* of the base end part 68 of the second upper 64 is joined to the midsole 4 at part of the outer circumferential edge of the midsole 4 (sole) or near the outer circumferential edge. Although each of the inner end 66*a* of the base end part 66 of a first upper 62 and the inner end 68*a* of the base end part 68 of a second upper 64 is sewn onto the insole 8, as described above, it does not mean that the first upper 62 and the second upper 64 are joined together.

The sock liner 10 forms a bottom surface of the internal space of the shoe and prevents the insole 8 or the joint part of the upper 6 coming into contact with the bottom surface of a foot. The sock liner 10 includes a curved part 10*a* that curves upward on the medial side of the midfoot portion such as to fit a foot shape. More specifically, the curved part 10*a* of the sock liner 10 curves upward at a position corresponding to a region where a second upper 64 is provided. Accordingly, the sock liner 10 curves upward in a region where a first upper 62 and a second upper 64 are provided to have a double-layered structure. The sock liner 10 may be formed to be almost flat and may be, when inserted into the shoe 1, brought into contact with the first upper 62 to be deformed upward. Also, the sock liner 10 may be curved upward or made deformable in an upward direction at a position corresponding to an MP joint.

Figure 6:
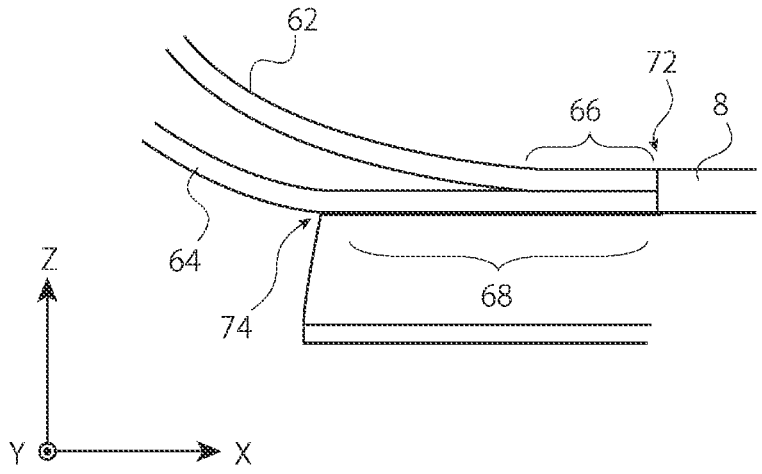
FIG. 6 is a sectional view along the X-Z plane of the shoe.
Figure 7:
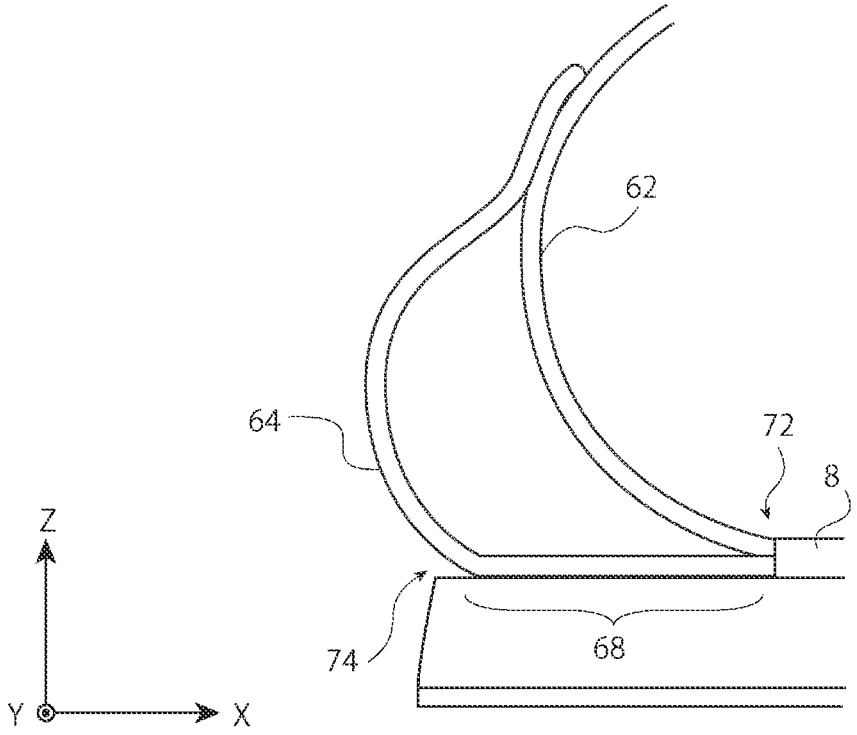
FIG. 7 is another sectional view along the X-Z plane of the shoe.

A joint position (first joint position) 72 between a first upper 62 and the sole and a joint position (second joint position) 74 between a second upper 64 and the sole have positional relationships as shown in FIGS. 5 and 6. FIG. 5 is a top view of the shoe in which part of the upper is omitted, and FIGS. 6 and 7 are sectional views along the X-Z plane of the shoe. In FIG. 5, the first joint position 72 is indicated by a dashed dotted line, and each second joint position 74 is indicated by a dashed double-dotted line. Also, in the illustration in FIGS. 6 and 7, a first upper 62 and a second upper 64 are developed, for the sake of convenience.

When a second upper 64 is provided, the base end part 66 of sheet shape of a first upper 62 and the base end part 68 of sheet shape of the second upper 64 are laminated in the portion where the second upper 64 is provided. The portion where the base end part 66 of the first upper 62 and the base end part 68 of the second upper 64 are laminated, i.e., the position where both the first upper 62 and the second upper 64 are provided, may suitably be located on the medial side of the midfoot portion. In this case, the fit in the longitudinal arch part of a foot can be improved. Also, the position where both the first upper 62 and the second upper 64 are provided may suitably be at least a position in a virtual line corresponding to the MP joints Ja of a foot on both the medial side and the lateral side, or a region Ja-A including areas in front of and in the rear of the virtual line. This region corresponds to a portion between the positions of about 20% and 40% from the toe side when it is restated with the shoe length ratio. In this case, the fit around a position corresponding to the MP joints, which is widest in a foot, can be improved.

As illustrated in FIGS. 5 and 6, since the inner end of the base end part 66 of the first upper 62 is joined to the insole 8, the contour of the first joint position 72 almost corresponds to the outer shape of the insole 8. Also, the first joint position 72 on the medial side is located closer to the middle in a width direction than the first joint position 72 on the lateral side. Accordingly, the amount of deformation of the first upper on the medial side can be increased so that the first upper especially fits onto the longitudinal arch part as appropriate. On the medial side of the midfoot portion, the first joint position 72 may be made to bulge toward the medial side with respect to the outer shape of the insole 8. The base end part 68 of the second upper 64 joined to the top surface of the midsole 4 may suitably be joined to the midsole 4 along the outer circumferential edge of the midsole 4. Accordingly, the contour of the second joint position 74 almost corresponds to part of the outer circumferential edge of the midsole 4. The second joint position 74 may be disposed along a line inside the part of the outer circumferential edge of the midsole 4 such as to provide a space between the second joint position 74 and the outer circumferential edge of the midsole 4. When the first joint position 72 and the second joint position 74 are compared, the first joint position 72 is located on the inside in a width direction of the second joint position 74.

As illustrated in FIG. 7, when the shoelace is tied and the first upper 62 is lifted upward, the base end part 66 of the first upper 62 moves away from the top surface of the midsole 4, and the first upper 62 extends from the first joint position 72 in a Z direction. When the first upper 62 is lifted, the second upper 64 is also lifted in a Z direction to extend from the second joint position 74 in the Z direction. At the time, a space is formed between the first upper 62 and the second upper 64.

As described above, when a first upper 62 is provided and the first joint position is located inside in a width direction by a predetermined distance with respect to the outer circumferential edge of the sole or suitably located around the middle in a width direction of the shoe 1, the fit can be improved. Also, when a second upper 64 is provided, the unity of the first upper 62 and the sole (particularly the midsole 4 and the outsole 2) can be maintained.

The present invention is not limited to the aforementioned embodiment, and modifications may be appropriately made to each configuration without departing from the scope of ideas of the present invention.

When the embodiment is generalized, the following aspects can be derived.

Aspect 1

A shoe, including:

a sole; and an upper joined to the sole, wherein a joint position between the sole and a base end part of the upper is located inside in a width direction by a predetermined distance with respect to an outer circumferential edge of a top surface of the sole.

This configuration improves the fit of the shoe.

Aspect 2

A shoe, including:

a sole;

a first upper joined to the sole; and a second upper disposed on the outside in a width direction of the first upper, wherein a first joint position between the sole and a base end part of the first upper is located on the inside in a width direction of a second joint position between the sole and a base end part of the second upper, and an upper edge of the second upper is joined to the first upper.

This configuration improves the fit of the shoe.

Aspect 3

The shoe according to Aspect 2, wherein the first upper and the second upper are joined only at the upper edge of the second upper.

This configuration makes the first upper and the second upper move freely with respect to each other.

Aspect 4

The shoe according to Aspect 2 or 3, wherein the second upper has higher stretchability than the first upper.

This configuration improves unity of the first upper and the sole.

Aspect 5

The shoe according to any one of Aspects 2 through 4, wherein the base end part of the first upper and the base end part of the second upper are formed into sheet shapes and laminated.

With this configuration, a foot can be supported by a surface.

Aspect 6

The shoe according to Aspect 5, wherein a portion where the first upper and the second upper are laminated is formed on a medial side of a midfoot portion.

This configuration improves the fit at a position corresponding to the longitudinal arch part of a foot.

Aspect 7

The shoe according to Aspect 5 or 6, wherein a portion where the first upper and the second upper are laminated is provided at least in a region including areas in front of and in the rear of a virtual line corresponding to the MP joints of a foot on both the medial side and a lateral side.

This configuration improves the fit around a position corresponding to the MP joints, which is widest in a foot.

Aspect 8

The shoe according to any one of Aspects 2 through 7, wherein, at least in the midfoot portion, the first joint position on the medial side is located closer to the middle in a width direction than the first joint position on the lateral side.

With this configuration, the amount of deformation of the first upper on the medial side can be increased so that the first upper especially fits onto the arch part as appropriate.

Aspect 9

The shoe according to any one of Aspects 2 through 8, further including a sock liner disposed to cover the first joint position, wherein a medial side end in a width direction of the sock liner is curved upward or deformable in an upward direction.

This configuration prevents the sock liner from interfering with the deformation of the first upper.

Aspect 10

The shoe according to Aspect 9, wherein the sock liner is curved upward or deformable in an upward direction in the midfoot portion.

This configuration prevents the sock liner from interfering with the deformation of the first upper, especially around the longitudinal arch part.

Aspect 11

The shoe according to Aspect 9, wherein the sock liner is curved upward or deformable in an upward direction at a position corresponding to an MP joint.

This configuration prevents the sock liner from interfering with the deformation of the sole at a position corresponding to an MP joint.

Aspect 12

The shoe according to any one of Aspects 2 through 11, wherein the joint position between the upper edge of the second upper and the first upper is visually recognizable when viewed from the top.

This configuration can make the second upper fit such as to wrap a foot from above and below.

Aspect 13

The shoe according to any one of Aspects 2 through 12, wherein the first upper includes a tightening part, and the joint position between the upper edge of the second upper and the first upper is located on the sole side with respect to the tightening part.

With this configuration, stretchability of the second upper can be maintained without influence of the tightening state of the tightening part.

INDUSTRIAL APPLICABILITY

The present invention is industrially applicable to the field of shoes.

REFERENCE SIGNS LIST

1 shoe
2 outsole
4 midsole
6 upper
8 insole
10 sock liner
62 first upper
64 second upper
66, 68 base end part
72 first joint position
74 second joint position

The invention claimed is:

1. A shoe, comprising:

a sole including a midsole and an insole, wherein the insole is disposed on the midsole, and wherein an end of the insole is located closer to a middle in a width direction of the shoe than to an outer periphery of the midsole;

a first upper joining the end of the insole such that a position where the first upper meets the end of the insole is located closer to the middle in the width direction of the shoe than to the outer periphery of the midsole; and a second upper externally covering the first upper, wherein the second upper joins the end of the insole, wherein the second upper joins the midsole, and wherein a position where the second upper meets the midsole is located closer to the outer periphery of the midsole than a position where the second upper meets the end of the insole, wherein the second upper includes an end that joins the end of the insole and an upper edge disposed on an opposite end of the end of the second upper, wherein the upper edge of the second upper joins the first upper, wherein the first upper includes tightening parts for tightening the first upper, and wherein the second upper has higher stretchability than the first upper such that when the tightening part tightens the first upper, the first upper is tightened prior to the second upper is tightened so that a space is formed between the first upper and the second upper.

2. The shoe according to claim 1, further comprising a sock liner disposed to cover the position where the first upper joins the end of the insole and the position where the second joins the end of the insole, wherein a medial side end of the sock liner that is located on the medial side of the shoe curves upward or deformable in an upward direction.

3. The shoe according to claim 2, wherein the sock liner curves upward or deformable in the upward direction in a midfoot portion of the shoe.

4. The shoe according to claim 2, wherein the sock liner is curved upward or deformable in the upward direction at a position corresponding to an MP joint when wearing.

5. The shoe according to claim 1, wherein a position where the upper edge of the second upper meets the first upper is located higher than a portion projecting outermost in the shoe and is located closer to the sole of the shoe than the tightening part of the first upper.

* * * * *